US006518527B2

(12) United States Patent
Watanabe et al.

(10) Patent No.: US 6,518,527 B2
(45) Date of Patent: Feb. 11, 2003

(54) PUSH SWITCH HAVING REDUCED SIZE

(75) Inventors: Hisashi Watanabe, Okayama (JP); Koji Sako, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/805,441

(22) Filed: Mar. 14, 2001

(65) Prior Publication Data

US 2001/0022269 A1 Sep. 20, 2001

(30) Foreign Application Priority Data

Mar. 15, 2000 (JP) ..... 2000-071816

(51) Int. Cl.[7] ..... H01H 1/06
(52) U.S. Cl. ..... 200/406; 200/284
(58) Field of Search ..... 200/406, 284

(56) References Cited

U.S. PATENT DOCUMENTS 4,463,233 A * 7/1984 Tanabe ..... 200/406
4,585,914 A * 4/1986 Ohashi et al. ..... 200/284
5,634,552 A * 6/1997 Soberski ..... 200/284
5,726,400 A * 3/1998 Masuda ..... 200/16 D
5,842,561 A * 12/1998 Takahashi ..... 200/406
6,140,596 A * 10/2000 Tsay ..... 200/406

* cited by examiner

*Primary Examiner*—Renee Luebke
(74) *Attorney, Agent, or Firm*—McDermott, Will & Emery

(57) ABSTRACT

A push switch used in an electronic apparatus is provided which has a thin switch case in spite of fixed contacts embedded in the bottom of the case. When the push switch is depressed, a center fixed contact and an outer fixed contact both made of metal strip and embedded in the bottom of the switch case is electrically connected and disconnected to each other by a movable contact. In the fixed contacts, embedded thin portions are formed, which is thinner than that of the metal strip as the material. As the thin portions are embedded in the switch case, the overall thickness of the bottom of the case is reduced, thus contributing to the thinner push switch.

14 Claims, 10 Drawing Sheets

PUSH SWITCH HAVING REDUCED SIZE

FIELD OF THE INVENTION

The present invention relates to a push switch installed in an operating section of an electronic apparatus.

BACKGROUND OF THE INVENTION

As a variety of electronic apparatuses have been reduced in the overall size or the thickness, push switches used in those electronic apparatuses are also required to be downsized.

A conventional push switch comprises a switch case made of insulating resin, protruding contacts arranged integral with a connector terminal accommodated in a recess of the case, and a movable contact. The protruding contacts are fixed by insert-shaping technique to project by a predetermined distance from the bottom of the recess. The movable contact electrically connects and disconnects between the protruding contacts.

A conventional push switch having such a construction will be explained referring the relevant drawings.

FIG. 9 is an upper view of the switch case of the push switch, FIG. 10 is a cross sectional view taken along the line 10—10 of FIG. 9, and FIG. 11 is a cross sectional view taken along the line 11—11 of FIG. 9. A center contact 2 and an outer fixed contact 3 both having a protrusion are fixed by insert-shaping technique on the bottom of an recess of a box-shape switch case 1 made of insulating resin. The contacts 2 and 3 link integrally with connector terminals 2A and 3A, respectively, which extend out of the switch case 1. The linking portions, leads 2B and 3B, are bent to extend substantially in parallel with the bottom of the recess of the switch case I and embedded in the switch case 1. The contacts 2 and 3 are usually bent at their ends 2C and 3C downwardly, while securely embedded in the bottom of the case 1. A movable contact 4 made of elastic thin metal has an upwardly curved dome shape. The movable contact 4 is placed with its outer rim 4A directly on the outer fixed contact 3 in the case 1. The outer rim 4A of the movable contact 4 is electrically insulated from the lead 2*b* of the center contact 2 by the insulating resin of the switch case 1 covering the upper surface of the lead 2B. The movable contact 4 is protected at the upper side with a flexible insulating film 5 on which an adhesive is applied at the lower side thereof. The film 5 is bonded to a side wall 1A around the recess of the switch case 1 for covering the upper opening of the switch case 1. The film 5 is also bonded to a center top 4B of the movable contact 4 for holding the contact 4 at a certain location in the case 1, thus protecting the inside of the switch case 1 from any dusts such as fluxes.

The operation of the conventional push switch will now be explained. When the insulating film 5 is pressed from above with a pressing force, the movable contact 4 is also pressed through the film. As the pressing force exceeds a certain level, the dome shape of the movable contact 4 is turned over to press with its center top 4*b*, and the contact 4 makes the center fixed contact 2 electrically connect with the outer fixed contact 3 via the movable contact 4, thus connecting between the two connector terminals 2A and 3A to turn the switch on. Then, when the pressing force is canceled, the movable contact 4 returns back to its original dome shape by a spring back force, and the switch returns back to be turned off shown in FIG. 9.

In the conventional push switch, the leads 2B and 3B of the fixed contacts 2 and 3 are bent at their ends 2C and 3C and embedded in the bottom of the switch case 1. And the bottom of the switch case 1 needs hence to be thick enough for accommodating the leads 2B and 3B therein. Accordingly, the conventional push switch is hardly reduced in the overall thickness.

SUMMARY OF THE INVENTION

A push switch is provided which having a bottom thereof reduced in the thickness in spite of embedding fixed contacts in the bottom.

In the push switch, a pair of fixed contacts made of metal strip and embedded in the bottom of the switch case electrically be connected and disconnected to each other by pressing a movable contact. In particular, the fixed contacts have thinner embedded portions than the other portions of them. Accordingly, as the fixed contacts are embedded at their thin portions in the switch case made of insulating resin, the push switch is reduced in the overall thickness without difficulty.

DESCRIPTION OF THE PREFERRED EMBODIMENTS

Some embodiments of the present invention will be described referring to the relevant drawings. Like elements in the conventional switch will be denoted by like numerals and will be explained in no more detail.

Embodiment 1

Figure 1A:
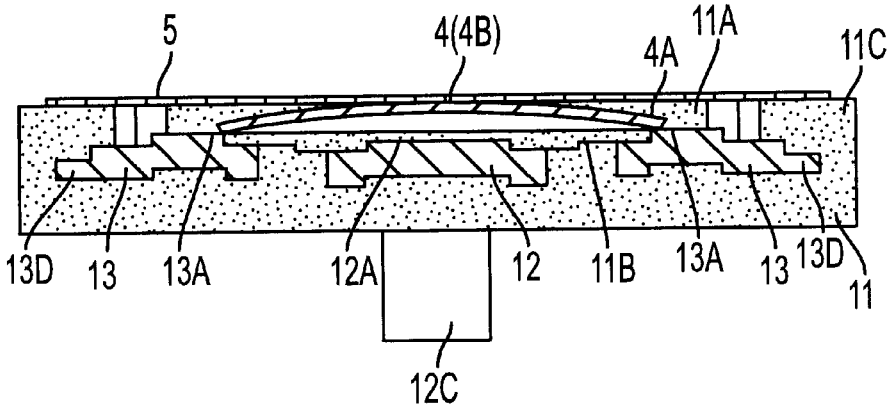
FIGS. 1*a* and 1*b* are cross sectional views of a push switch according to embodiment 1 of the present invention.
Figure 1B:
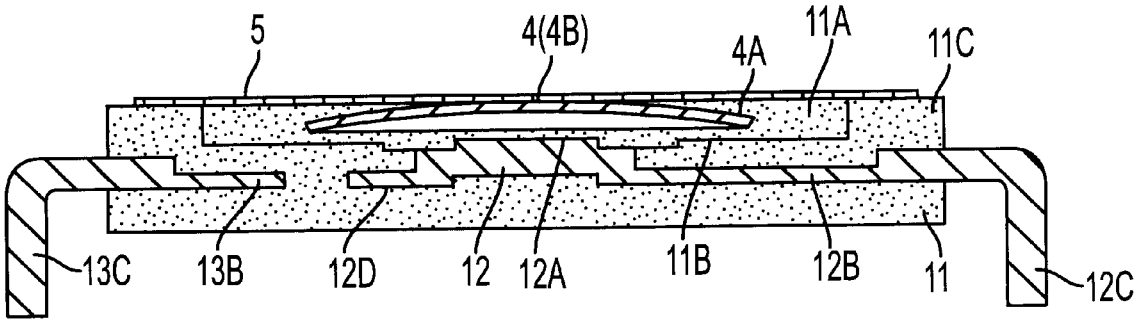
Figure 2:
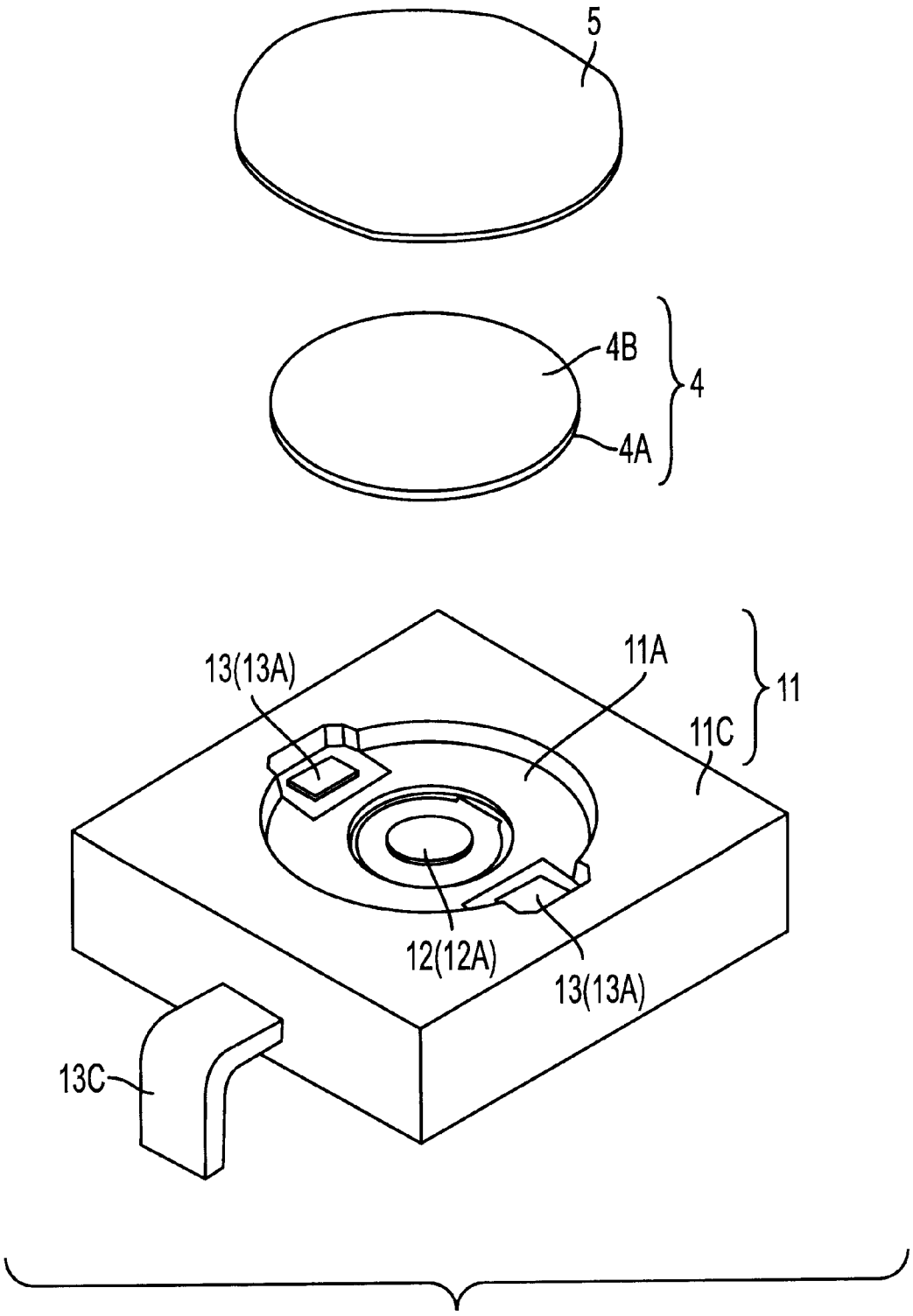
FIG. 2 is an exploded perspective view of the push switch according to embodiment 1.
Figure 3:
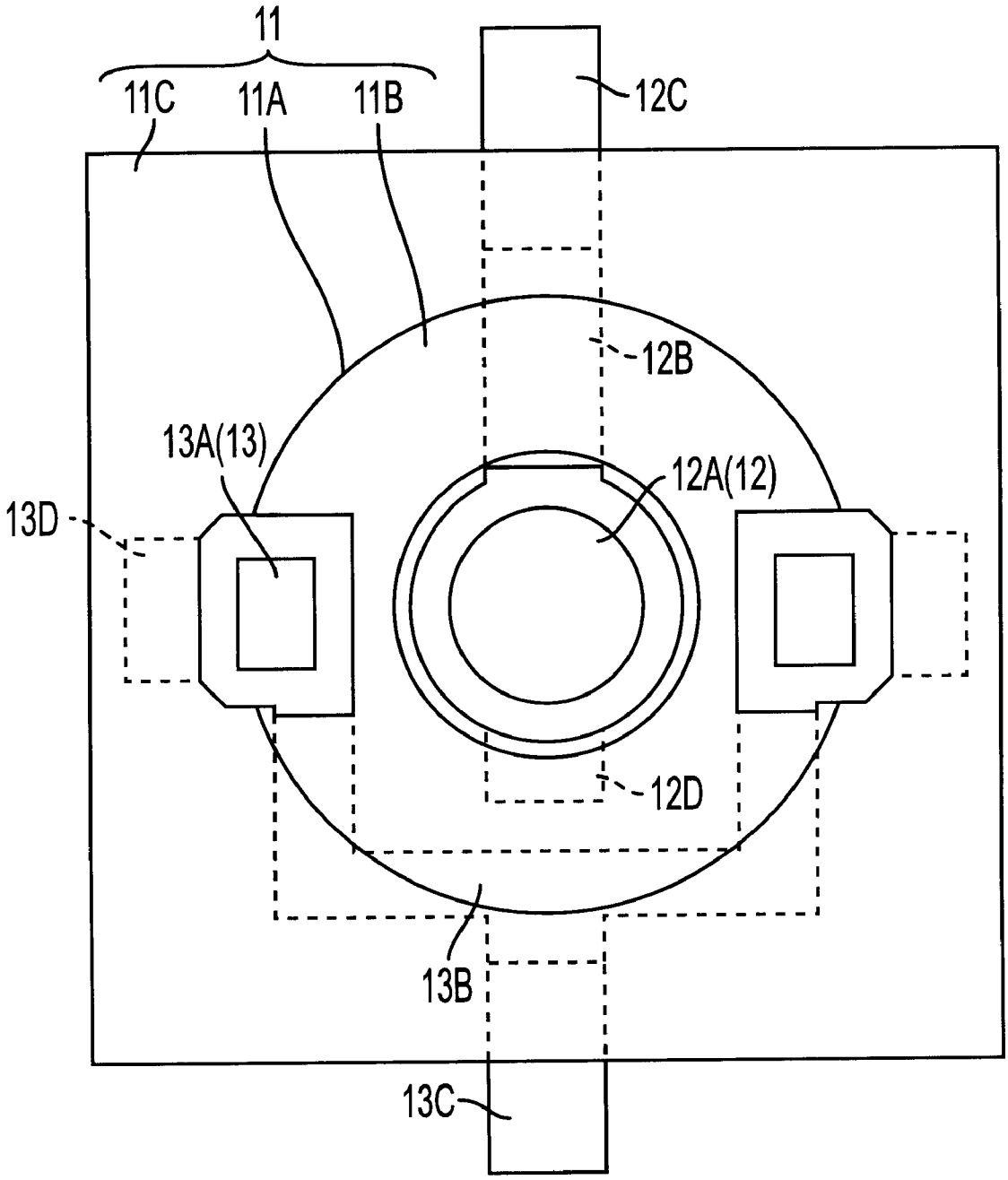
FIG. 3 is an upper view of a switch case of the push switch according to embodiment 1.

FIGS. 1(*a*) and 1(*b*) are cross-sectional views of a push switch according to Embodiment 1 of the present invention. FIGS. 2 and 3 are an exploded perspective view and an upper view of the switch. A switch case 11 made of insulating resin has an upper opening recess 11A provided therein. A center fixed contact 12 made of a metal strip having a protruding center contact portion 12A and an outer fixed contact 13 made of a metal strip having a pair of protruding outer contact portions sandwiching the center contact portion 12A from both sides are mounted in the bottom 11B at the recess 11A of the switch case 11 by insert shaping technique. The two fixed contacts 12 and 13 extend linearly through their corresponding leads 12B and 13B to the outside of the switch case 11, respectively. And the contacts 12 and 13 have connector terminals 12C and 13C at their extending portions, respectively.

The portions of the leads 12B and 13B are shaped by a compression working to be thin enough to be embedded in the recess 11A of the case 11 and to be thinner than the metal strips as material. That is, the thin portions of the leads 12B and 13B are embedded in the insulating resin of the case 11.

The fixed contacts 12 and 13 have ends 12D and 13D thereof respectively shaped by a compression working, and thus, the ends become thin portions embedded in the insulating resin of the switch case 11, respectively.

A movable contact 4 made of an elastic dome-shaped metal disk is accommodated in the switch case 11 with outer rim 4A thereof placed directly on the outer contact portions 13A of the outer fixed contact 13. The outer rim 4A of the movable contact 4 is located above the lead 12B of the center fixed contact 12. As described above, the lead 12B has the thin portion embedded in the insulating resin of the switch case 11. This allows the movable contact 4 to be electrically insulated from the center fixed contact 12 securely.

A flexible film 5 having a lower side thereof applied with an adhesive is bonded to a side wall 11C around the recess 11A of the switch case 11 to close off the upper opening of the case 11. The film 5 is tacked with its lower side to a center top 4B of the dome-shaped movable contact 4, thus holding the movable contact 4 in a certain location in the switch case 11 and protecting the inside of the case 11 from dusts or fluxes.

The side wall 11C of the switch case 11 is equal or slightly higher than the center top 4B of the movable contact 4 and surrounding the movable contact 4.

The push switch according to embodiment 1 has thin portions at the contacts 12, 13 and the ends 12D, 13D of the leads 12B and 13B, respectively. This allows the bottom of the switch case 11 not to be thick for accommodating the bent contacts in contrast with the conventional push switch, but allows it to be thick enough to hold the fixed contacts 12 and 13. Accordingly, the bottom of the switch case 11 has a reduced thickness without difficulty. As the switch case 11, which determines the overall thickness of the push switch, becomes thin, the push switch according to embodiment 1 can be thin.

While the ends 12D and 13D and the leads 12B and 13B of the fixed contacts 12 and 13 are embedded in the insulating resin of the switch case 11, respectively, the fixed contacts 12 and 13 can securely be held at their step portions.

The thin ends 12D and 13D of the fixed contacts 12 and 13 may be provided at more positions. For improving the strength of securing the fixed contacts 12 and 13 to the switch case 11, the thin portions of the ends 12D, 13D and the leads 12B, 13B may be shaped in a tilted planar shape, an undulated shape, or a waveform shape.

The thin portions may be formed by a mechanical compression working, which is easy and less in steps, hence contributing to the low-cost production of the push switch. The method of forming the thin portions is not limited to the compression working but to a cut working or any other appropriate technique. The fixed contacts may be prepared by punching out from a metal of which thickness is varied therein.

The fixed contacts 12 and 13 may be silver-plated. The distance of 0.2 mm or more between the center fixed contact 12 and the outer fixed contact 13 avoids an electrical migration between them may successfully be avoided even under high-temperature and high-moisture circumstances, thus providing a push switch having high stability regardless of the operation conditions.

The operation of the push switch according to this embodiment used in an electronic apparatus and manually-operated will now be explained.

Figure 4:
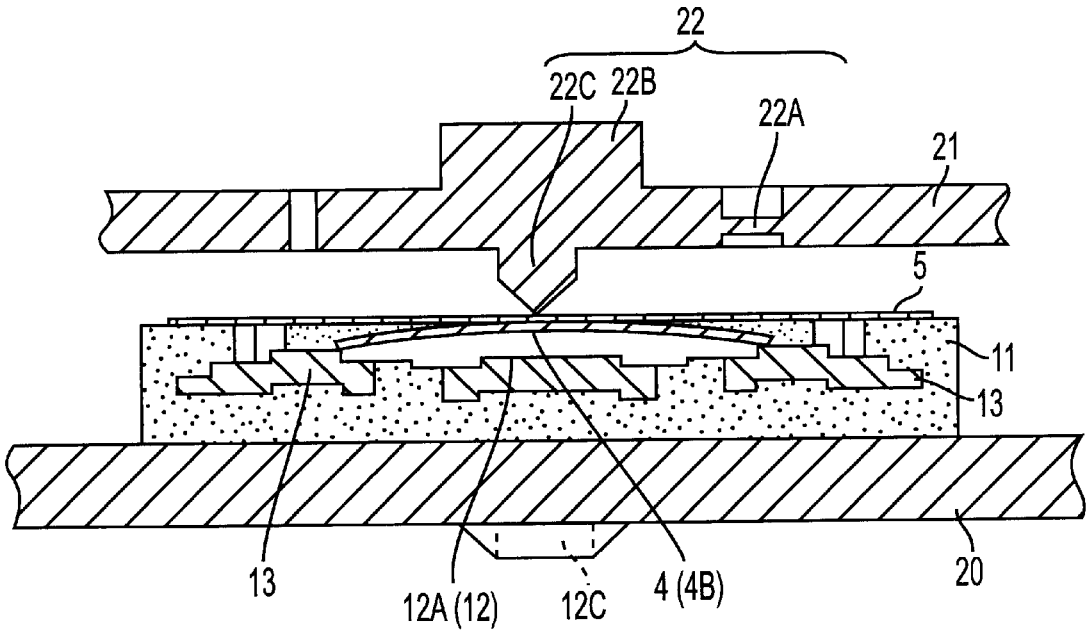
FIG. 4 is a cross sectional view for explaining an operation of the push switch according to embodiment 1.

FIG. 4 is a cross sectional view illustrating the use of the push switch according this embodiment. The electronic apparatus where the push switch is installed has a printed circuit board (PCB) 20. The push switch is soldered at their connector terminals 12C and 13C (13C is not shown) and placed at a certain position on the PCB 20. A push-button 22 is formed integral with the resin case 20 of the electronic apparatus with a thin hinge 22A joining it to the case 20. The push-button 22 has an upward-protruding key 22B and a downward-protrusion 22C thereof which stays in direct contact with the center of the flexible insulating film 5 of the push switch.

When the key portion 22B of the push-button 22 is depressed by a pressing force, the push-button 22 tilts down on the hinge 22A as a fulcrum. This causes the protrusion 22C to urge the flexible film 4 and thus press down the center top 4B of the dome-shaped movable contact 4. As the pressing force exceeds a predetermined level, the movable contact 4 is turned over with a click, and the top 4B at its lower side directly contacts with the center contact portion 12A of the center fixed contact 12 securely fixed in the switch case 11. As a result, the movable contact 4 connects electrically the center fixed contact 12 to the outer fixed contact 13, thus turning the switch on. Consequently, printed wires linked to the connector terminals 12C and 13C on the PCB 20 are connected to each other. When the pressing force to the key 22B is canceled, the movable contact 4 returns back to its original shape by its spring back and lifts up the push button 22, thus turning off the switch as shown in FIG. 4.

The electronic apparatus using the push switch as a component according to this embodiment is easily reduced in the thickness because the switch is thin, while the push switch can be operated with a click touch and the operating.

Embodiment 2

Figure 5A:
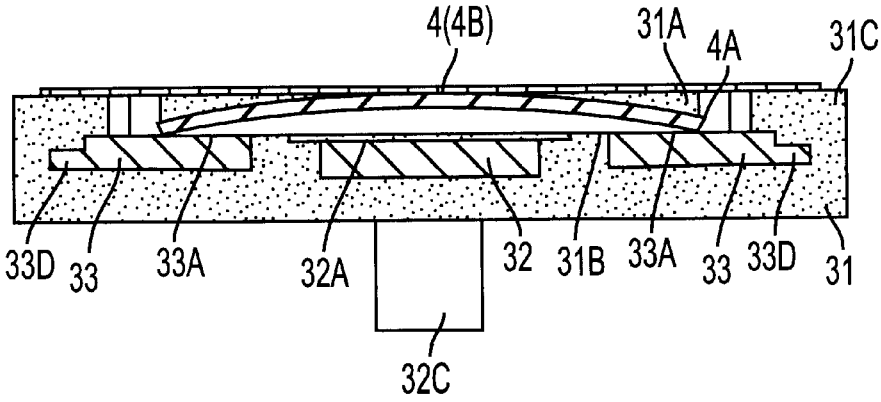
FIGS. 5*a* and 5*b* are cross sectional views of a push switch according to embodiment 2 of the present invention.
Figure 5B:
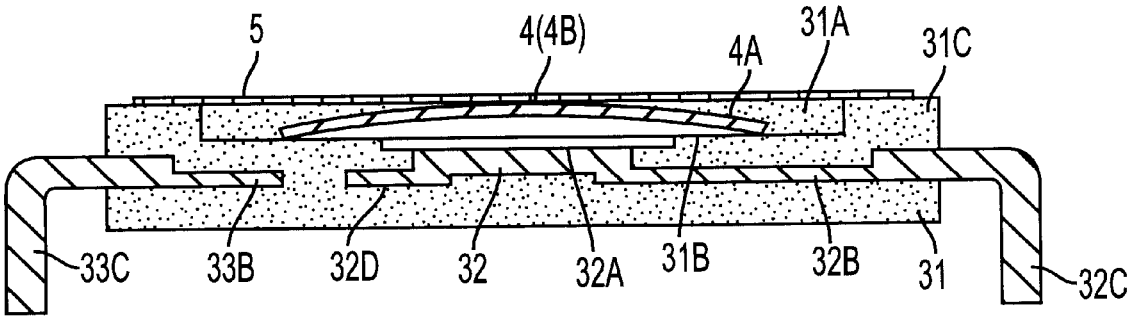
Figure 6:
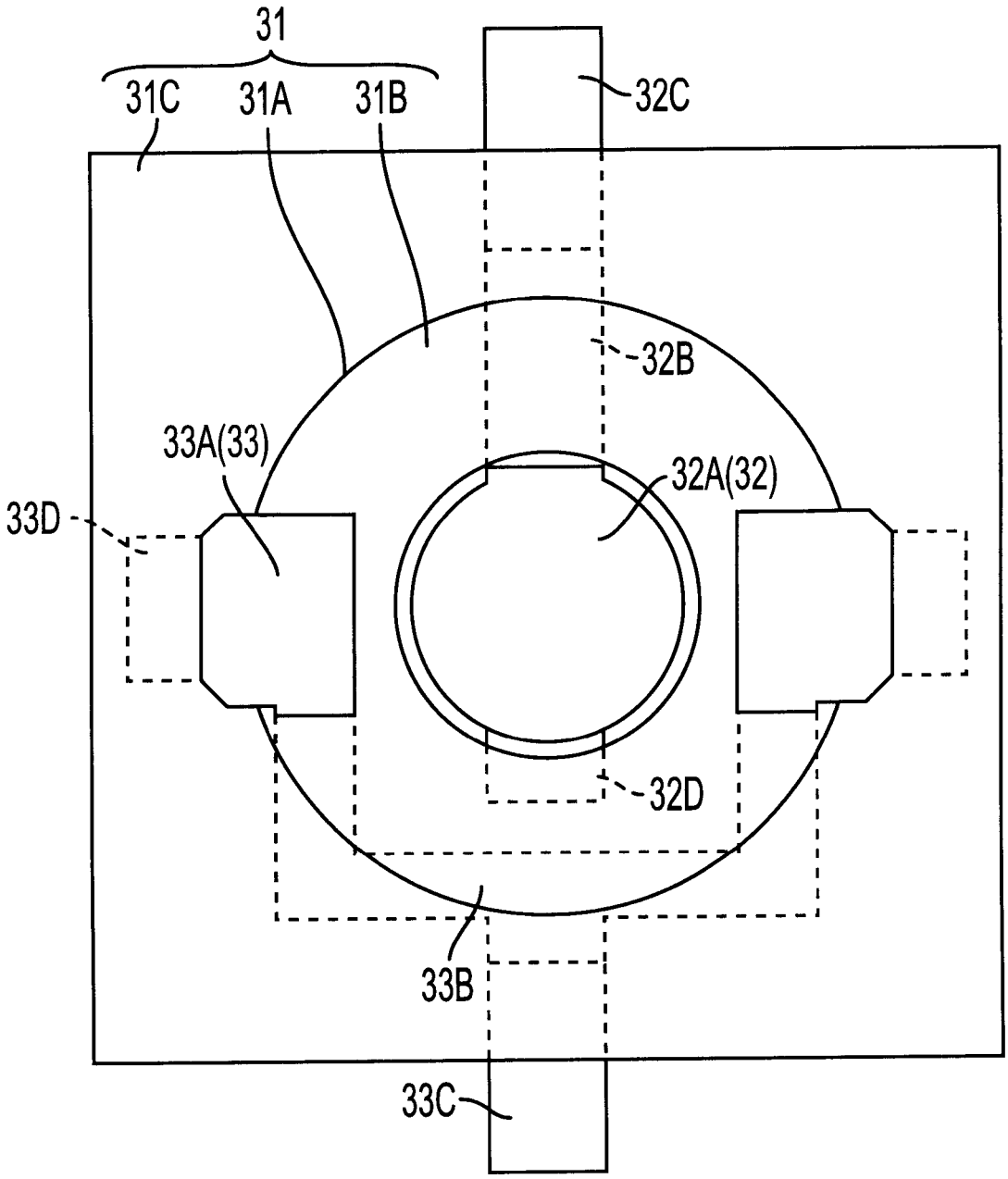
FIG. 6 is an upper view of a switch case of the push switch according to embodiment 2.

A push switch of this embodiment will be described referring to the cross sectional views in FIGS. 5(*a*), 5(*b*) and the upper view in FIG. 6.

The push switch according to embodiment 2 has a switch case 31. Similar to the push switch according to embodiment 1, a pair of a center fixed contact 32 and an outer fixed contact 33 sandwiching the contact 32 from both sides are fixed by insert shaping in the bottom 31B at a recess 31A of the switch case 31. The two contacts 32 and 33 have a center contact portion 32A and outer contact portions 33A, respectively, and the portions project substantially at the same height as the bottom 31B at a recess 31A.

The two fixed contacts 32 and 33 extend linearly to the outside of the switch case 31 through leads 32B and 33B, respectively. The contacts 32 and 33 have connector terminals 32C and 33C provided at the extending portions, respectively. The portions of the leads 32B and 33B are shaped by a compression working so as to be thin enough to be embedded in the bottom at the recess 31A of the switch case 31A. That is, the thinned leads 32B and 33B are embedded in the insulating resin of the switch case 31. The center contact 32A and the outer contact 33A of the fixed contact 32 and 33 are also fixed to the case 31 with thin portions of ends 32D and 33D embedded in the insulating resin of the case 31, respectively.

A movable contact 4 made of an elastic dome-shaped metal disk is accommodated in the switch case 31 with outer rim 4A thereof placed directly on the outer contact portions 33A of the outer fixed contact 33. A flexible film 5 is bonded to a side wall 31C of the switch case 31 to close off the upper opening of the case 31. The film 5 is tacked to a center top 4B of the dome-shape movable contact 4 thus holding the contact 4 in a certain position in the switch case 31.

In the lead 32B of the center fixed contact 32, a thin portion is formed at the position corresponding to the outer rim 4A of the movable contact 4. As the lead 32B is covered with the insulating resin of the switch case 31, the center fixed contact 32 is electrically isolated from the movable contact 4.

The push switch according to embodiment 2, as the same as that according to embodiment 1, allows the bottom of the switch case 31 to be thin. In addition, as the center contact portion 32A and the outer contact portions 33A project substantially at the same height as the bottom of the switch case 31, the overall thickness of the switch case 31 can be reduced. Accordingly, the push switch according to embodiment 2 becomes thin.

The operation of the push switch of Embodiment 2 is identical to that according to embodiment 1 and will be explained in no more detail.

The distance of 0.2 mm or more between the center fixed contact 32 and the outer fixed contact 33 avoids an electrical migration between them as similar to that in embodiment 1.

Forming a recess in the center contact portion 32A of the center fixed contact 32 increases a contact area between the portion and the lower side of the center top 4B of the movable contact 4, thus making the contacting stable.

Figure 7:
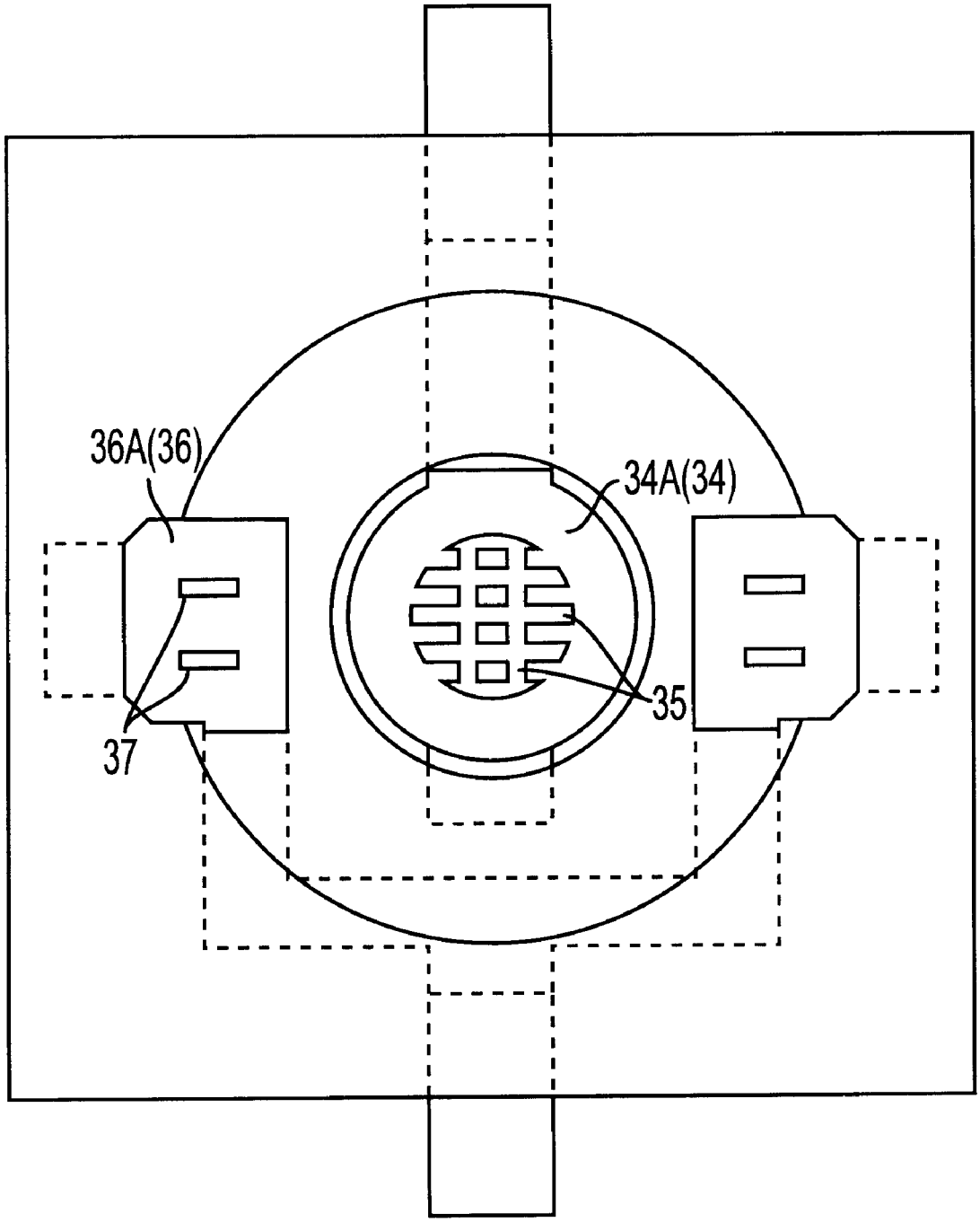
FIG. 7 is an upper view of a modification of the push switch according to embodiment 2.

As shown in an upper view of a modification of the push switch in FIG. 7, in the center contact 34A of a center fixed contact 34, plural recesses for multiple contacts may be formed. Forming plural recesses 35 in the center of the contact 34A increases contacting points between the lower side of the center protruding portion 4B of a movable contact 4 (not shown in FIG. 7) and the contact 34A at th e pressing down. That also increases a pressure of contact per unit area and thus ensures a secure and stable electrical connection between the movable contact 4 and the center fixed contact 34.

Also as shown in FIG. 7, in each outer contact portion 36A of an outer fixed contact 36, a number of recesses 37 may be formed for increasing the contact points. To speak more specifically, forming, in the outer contact portion 36A, recesses 37 extending substantially at a right angle to the outer rim 4A of the movable contact 4 (not shown) increases a contact pressure per unit area against the lower side of the outer rim 4A, thus improving the stability for physical contact.

Embodiment 3

Figure 8:
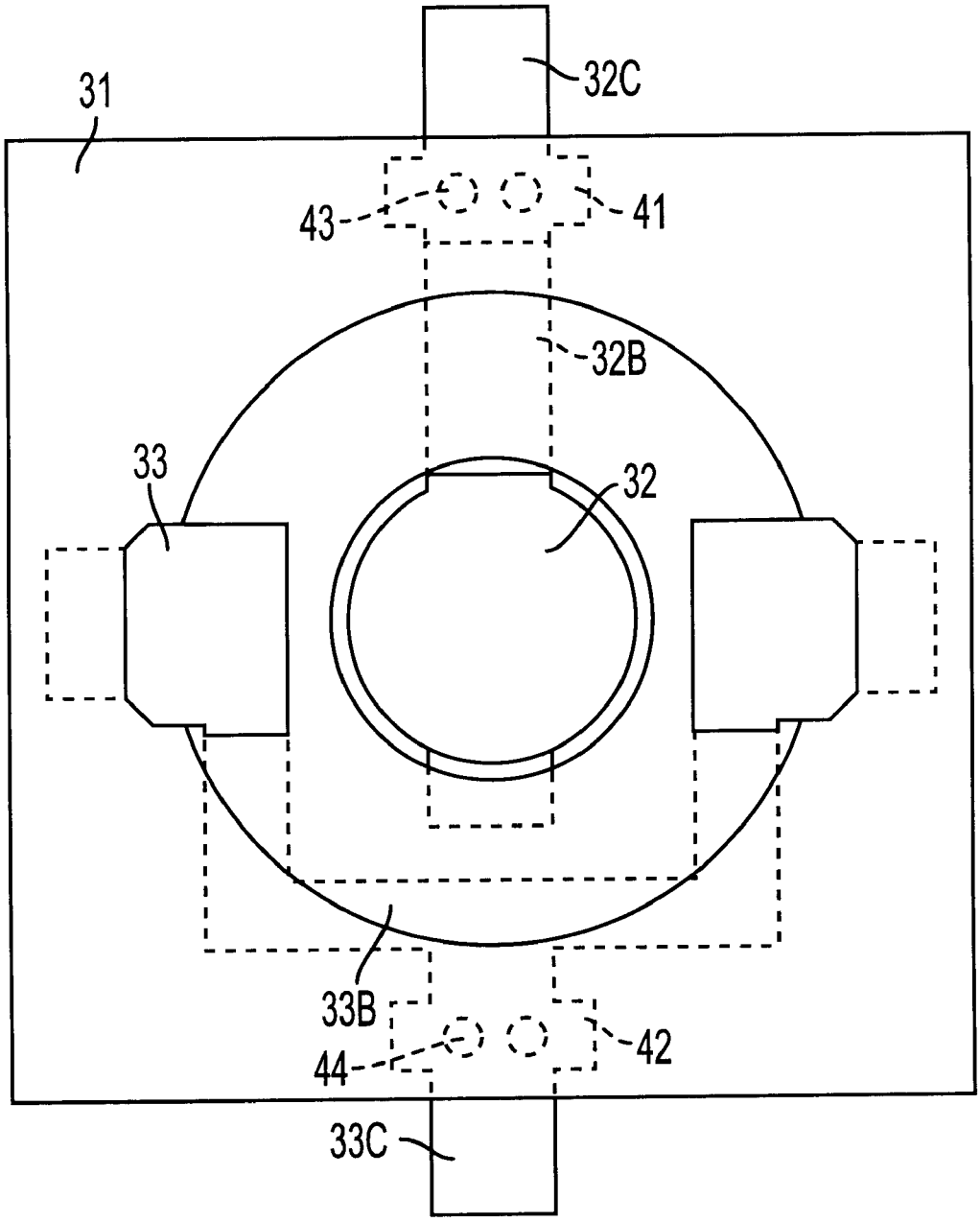
FIG. 8 is a cross sectional view of a switch case of a push switch according to embodiment 3 of the present invention.
Figure 9:
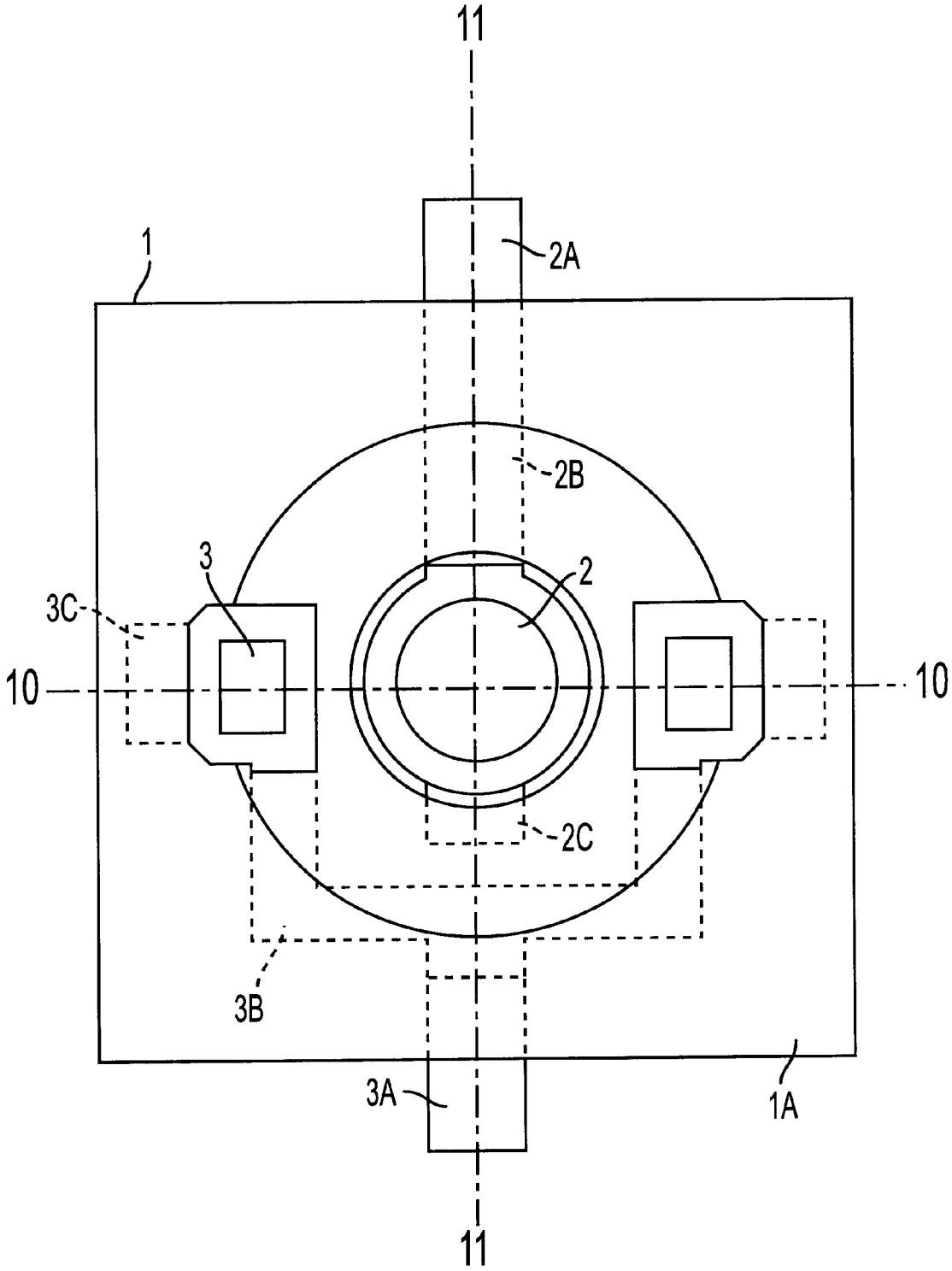
FIG. 9 (PRIOR ART)
FIG. 9 is an upper view of a switch case of a conventional push switch.
Figure 10:
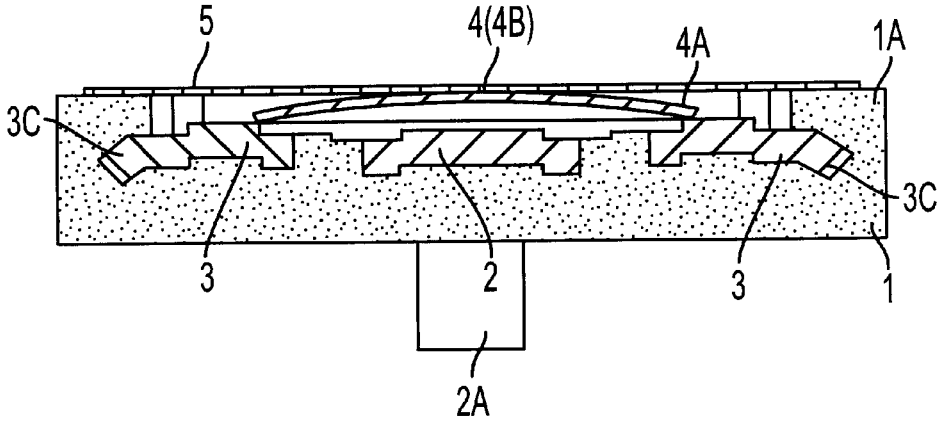
FIG. 10 (PRIOR ART)
FIG. 10 is a cross sectional view of the conventional push switch shown in FIG. 9.
Figure 11:
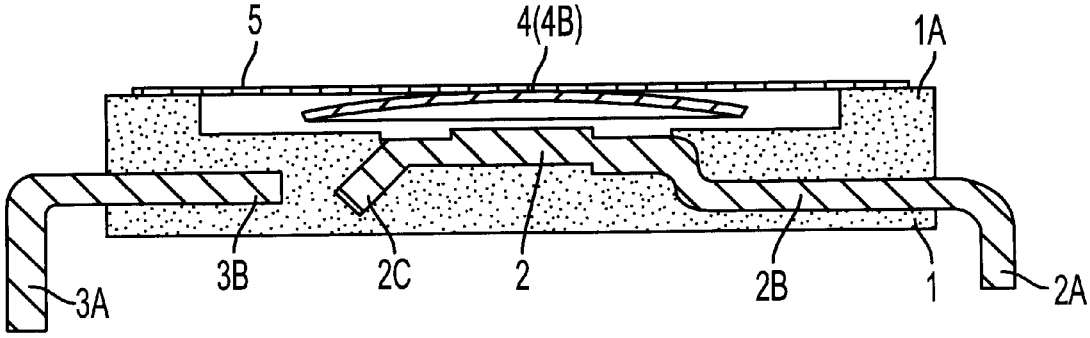
FIG. 11 (PRIOR ART)
FIG. 11 is a cross sectional view of the conventional push switch shown in FIG. 9.

A push switch according to embodiment 3 is strong for the tension in the direction of the connector terminal and for soldering heat applied when soldered to the electronic apparatus. Referring to the upper view in FIG. 8 illustrating a switch case of the push switch, a particular feature of the switch according to embodiment 3 different from embodiment 2 will be described.

In the push switch according to embodiment 3, overhanging portions 41 and 42 extending horizontally in the widthwise direction are provided between the lead 32B and the connector terminal 32C of a center fixed contact 32 and between the lead 33B and the connector terminal 33C of an outer fixed contact 33, respectively.

The fixed contacts 32 and 33 having their leads 32B and 33B with the overhanging portions 41 and 42 are securely fixed in a switch case 31. The contacts 32 and 33 are less affected by soldering heat generated when the push switch is soldered to an electronic apparatus because the heat is effectively irradiated from the portions 41 and 42. Also, any stress applied to the connector terminals 32C and 33C during the soldering can successfully be eased by the portions 41 and 42.

In addition, the leads 32B and 33B may have apertures 43 and 44, respectively. Filled up with an insulating resin of the switch case 31, the apertures 43 and 44 make the leads 32B and 33B be embedded in the case 31 securely. As a result, the strength of holding the leads 32B and 33B to the resin of the case 31 is highly increased. Accordingly, the overhanging portions 41 and 42 and the apertures 43 and 44 contribute to the improvement of the strength for the tension in the direction of the leads 41, 42 of the contacts 32, 33.

While the overhanging portions 41, 42 and the apertures 43, 44 are provided in the push switch according to Embodiment 2, they may be applied to that according to embodiment 1 with equal success.

What is claimed is:

1. A push switch comprising:

a switch case;

a plurality of fixed contacts, each of said plurality of fixed contacts being embedded in said switch case;

a movable contact for electrically connecting and electrically disconnecting said plurality of fixed contacts to one another;

wherein each of said fixed contacts comprises a contact portion for engaging said movable contact; a terminal portion having a first end embedded in said switch case and a second end accessible from outside said switch case; and a lead portion embedded in said switch case for electrically coupling said contact portion to said terminal portion, said lead portion having a reduced thickness relative to said contact portion and said terminal portion.

2. The push switch according to claim 1, wherein each of said fixed contacts further include a protruding portion extending from a side of said contact portion, said protruding portion have a reduced thickness relative to said contact portion, said protruding portion being embedded in said switch case.

3. The push switch according to claim 1, wherein said plurality of fixed contacts include a center fixed contact and an outer fixed contact; said movable contact has a dome-shaped configuration and comprises an outer rim electrically coupled to said outer fixed contact; and said lead portion of said center fixed contact extends beneath said outer rim of said movable contact.

4. The push switch according to claim 3, wherein the distance between said center fixed contact and said outer fixed contact is 0.2 mm or greater.

5. The push switch according to claim 3, wherein a recess is formed in an upper surface of said contact portion of said center fixed contact.

6. The push switch according to claim 3, wherein a plurality of recesses are formed in an upper surface of said contact portion of said center fixed contact.

7. The push switch according to claim 3, wherein a recess is formed in an upper surface of said contact portion of said outer fixed contact.

8. The push switch according to claim 3, wherein a plurality of recesses are formed in an upper surface of said contact portion of said outer fixed contact.

9. The push switch according to claim 1, wherein said terminal portion of each said fixed contact extends outside of said switch case so as to form a terminal connector.

10. The push switch according to claim 1, wherein a portion of said terminal portion embedded in said switch case exhibits an increased width.

11. The push switch according to claim 10, wherein said portion of said terminal portion having an increased width has at least one aperture formed therein.

12. The push switch according to claim 1, wherein an upper surface of said contact portion has a protrusion section for contacting said movable contact.

13. The push switch according to claim 1, wherein said contact portion is exposed at substantially the same height as a surface of said switch case through which said contact portion is exposed.

14. The push switch according to claim 1, wherein an upper surface of said contact portion is substantially level with an upper surface of a portion of said switch case through which said contact portion is exposed.

* * * * *